US007056878B2

(12) United States Patent
Fender et al.

(10) Patent No.: US 7,056,878 B2
(45) Date of Patent: Jun. 6, 2006

(54) RINSE CYCLE FABRIC SOFTENER FORMULATIONS CONTAINING BETAINE ESTER DERIVATIVES AND METHOD FOR IMPROVING THE WASHING PERFORMANCE OF DETERGENTS

(75) Inventors: Michael Fender, Flieden (DE); Jörg Simpelkamp, Richmond, VA (US); Philipp Tomuschat, Essen (DE); Bernd Weyershausen, Essen (DE)

(73) Assignee: Goldschmidt Rewo GmbH & Co. KG, Steinau an der Strasse (DE)

( * ) Notice: Subject to any disclaimer, the term of this patent is extended or adjusted under 35 U.S.C. 154(b) by 0 days.

(21) Appl. No.: 10/967,777

(22) Filed: Oct. 19, 2004

(65) Prior Publication Data

US 2005/0227904 A1 Oct. 13, 2005

Related U.S. Application Data

(63) Continuation of application No. PCT/EP03/03912, filed on Apr. 15, 2003.

(30) Foreign Application Priority Data

Apr. 20, 2002 (DE) ..... 102 17 705

(51) Int. Cl.
*C11D 1/645* (2006.01)

(52) U.S. Cl. ..... 510/504; 510/522; 510/527

(58) Field of Classification Search ..... 510/421, 510/426, 433, 436, 469, 489, 490, 499, 504, 510/522, 527

See application file for complete search history.

(56) References Cited

U.S. PATENT DOCUMENTS

| | | | | |
|---|---|---|---|---|
| 2,742,434 | A | 4/1956 | Kopp | 252/106 |
| 3,539,520 | A | 11/1970 | Cantor et al. | 252/106 |
| 3,951,879 | A | 4/1976 | Wixon | 252/547 |
| 3,959,157 | A | 5/1976 | Inamorato | 252/8.8 |
| 3,965,026 | A | 6/1976 | Lancz | 252/106 |
| 4,239,660 | A | 12/1980 | Kingry | 252/528 |
| 4,260,529 | A | 4/1981 | Letton | 252/547 |
| 4,370,272 | A | 1/1983 | Wechsler et al. | 260/404 |

FOREIGN PATENT DOCUMENTS

| | | |
|---|---|---|
| DE | 35 05 269 | 8/1986 |
| EP | 0 192 145 | 8/1986 |
| EP | 0 747 468 | 12/1996 |
| EP | 0 799 885 | 10/1997 |
| WO | WO 03/038022 | 5/2003 |
| WO | WO 03/089558 | * 10/2003 |

OTHER PUBLICATIONS

Abstract for WO 03/038022, Reference B1 above.
Abstract for EP 0 192 145, Reference B2 above.
Abstract for EP 0 747 468, Reference B3 above.
Abstract for DE 35 05 269, Reference B5 above.

* cited by examiner

*Primary Examiner*—John R. Hardee
(74) *Attorney, Agent, or Firm*—Michael A. Sanzo; Fitch, Even, Tabin & Flannery

(57) ABSTRACT

The invention relates to washing-softening rinsing formulations containing betaine ester derivatives which can be hydrolysed and liquidic esterquat-softening rinsing formulations for the controlled release of surfactants and a method for improving the washing performance of washing agents by using the washing-softening rinsing formulations.

15 Claims, No Drawings

RINSE CYCLE FABRIC SOFTENER FORMULATIONS CONTAINING BETAINE ESTER DERIVATIVES AND METHOD FOR IMPROVING THE WASHING PERFORMANCE OF DETERGENTS

CROSS REFERENCE TO RELATED APPLICATIONS

The present application is a continuation of international application PCT/EP03/03912, which has an international filing date of Apr. 15, 2003, and which was published in German under PCT Article 21(2) on Oct. 30, 2003. The international application claims priority under 35 U.S.C. § 119 to German application 102 17 705.8, filed on Apr. 20, 2002.

FIELD OF THE INVENTION

The invention provides rinse cycle fabric softener formulations comprising hydrolysable betaine ester derivatives alongside liquid esterquat rinse cycle softener formulations for controlled release of surfactants and an industrial method for improving the washing performance of detergents using the rinse cycle fabric softener formulations.

BACKGROUND OF THE INVENTION

The chemical and physical processes which proceed during the washing operation continue to be the subject of intensive research because of their complexity.

In all cases wetting of the goods to be cleaned with the wash liquor and phase inversion of the solid or oily particles of dirt is necessary for cleaning. Wetting and phase inversion are effected by surface-active substances, the surfactants. The electrochemical double layer formed between the fibre, dirt particles and surfactant is increased substantially by anionic surfactants and builders, as a result of which the repellency between the dirt and fibre is intensified.

The liquid grease and oil dirt detached is solubilized by the micelles formed by the surfactants and is thus held in the wash liquor. Particles of dirt are charged electrically by adsorption of surfactants and are dispersed in the wash liquor as a consequence of the repellency of the individual particles, so that no redeposition on the fabric takes place.

Nonionic surfactants are in general employed in detergent formulations because of their ability to remove greasy and oily dirt. According to the prior art, cationic surfactants are likewise used in detergent formulations, in particular also because of the additional textile care effects attributed to them, and not exclusively as cleaning agents. Such additional effects which are to be observed, depending on the structure of the cationic surfactants, are, for example, the softening (U.S. Pat. No. 3,607,763), the antistatic (U.S. Pat. No. 3,951,879; U.S. Pat. No. 3,959,157), the bactericidal (U.S. Pat. No. 2,742,434; U.S. Pat. No. 3,539,520; U.S. Pat. No. 3,965,026) and the colour-protecting action or also the improvement in the water uptake capacity of the fabric treated with them. Detergent formulations formulated with a basic pH in which selected nonionic and cationic surfactants are combined in order to achieve an improved removal of dirt are furthermore known, as described in the patents U.S. Pat. No. 4,239,660 or also U.S. Pat. No. 4,260,529.

U.S. Pat. No. 4,260,529 describes, for example, detergent formulations which comprise, in addition to a biodegradable nonionic surfactant, betaine ester derivatives in the form of cationic ammonium salts. These detergent formulations for the main washing operation are attributed a high washing action if they are employed in the main washing operation in an alkaline pH range of expressly below 11, so that hydrolysis of the surfactants employed is prevented.

Cationic surfactants of varying structure are employed as raw materials for rinse cycle fabric softeners. Ester compounds based on triethanolamine, such as N-methyl-, N,N-bis(beta-$C_{14-18}$-acyloxy-ethyl)-, N-beta-hydroxyethylammonium methosulfate, which are marketed under trade names such as Tetranyl® AT 75 (trademark of KAO Corp.), Stepanex® VRH 90 (trademark of Stepan Corp.) or Rewoquat® WE 18 (trademark of Goldschmidt Rewo GmbH & Co. KG), are particularly widely used.

U.S. Pat. No. 4,370,272 describes alkoxylated quaternary ammonium betaine ester surfactants and their use as hair conditioner or rinse cycle softener. Their self-emulsifying action in water and the possibility of omitting additional nonionic surfactants to achieve a stable emulsion are mentioned as advantages. However, the soft handle of laundry treated with such rinse cycle softeners does not meet the standards achieved by modern esterquat rinse cycle softeners.

A disadvantage of the prior art is furthermore that the surfactant molecules hitherto available have no or an inadequate substantivity in order to be adsorbed on to the fibres from the aqueous liquor, which applies in particular to nonionic surfactant molecules.

DESCRIPTION OF THE INVENTION

The object of the present invention was therefore to provide rinse cycle fabric softener formulations which show a clear rinsing power-intensifying effect on the next laundry and at the same time meet the standards of modern esterquat rinse cycle softener formulations, in particular in respect of the softening action, the antistatic action or the water uptake capacity of the fabric treated with them. To achieve this action, the constituents of the rinse cycle fabric softener formulations must be adsorbed on to the textiles (substantivity).

According to the invention, it has been found, surprisingly, that certain compounds which were applied together with commercially available rinse cycle softener formulations can significantly improve the washing action of conventional detergents in the following washing operation.

Nothing is as yet known in the literature of an activating action which treatment with a rinse cycle fabric softener could have on the effectiveness of the next washing operation after soiling and renewed washing.

The abovementioned object is achieved according to the invention by rinse cycle fabric softener formulations comprising betaine ester derivatives of the following general formula (I):

(I)

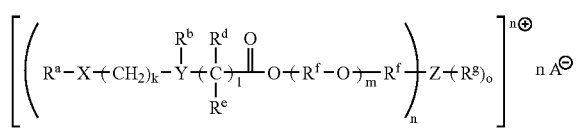

wherein

Y according to the formula (II)

$$Y = \underset{\underset{R^c}{|}}{N}, \underset{\underset{R^c}{|}}{P}, S \qquad \text{(II)}$$

represents a substituted phosphorus or nitrogen atom or a sulfur atom, $R^a$ is an optionally branched, optionally unsaturated radical having 1 to 30 C atoms which optionally contains a hydroxyl group or other heteroatom substituents, X is a radical from the group consisting of —O—C(O)—, —(O)C—O—, —NH—C(O)—, —(O)C—NH, —($CH_3$)N—C(O)—, —(O)C—N($CH_3$)—, —S($O_2$)—O—, —O—S($O_2$)—, —S($O_2$)—NH—, —NH—S($O_2$)—, —S($O_2$)—N($CH_3$)— and —N($CH_3$)—S($O_2$)—, $R^b$, $R^c$ are independent of one another and are optionally branched alkyl radicals having 1 to 4 C atoms, where these can optionally contain heteroatom substituents, the radicals $R^d$, $R^e$ independently of one another are chosen from hydrogen (H), optionally branched alkyl radicals having 1 to 4 C atoms, optionally substituted aryl or benzyl radicals and $CH_2COOH$, $CH_2COOR$, $CH_2CH_2COOH$ and $CH_2CH_2COOR$, $R^f$ is a branched and/or substituted and/or cyclic hydrocarbon radical having 1 to 10, preferably 2 or 3 carbon atoms which optionally contains multiple bonds or a styrene radical or is composed exclusively of ethylene, propylene, butylene or styrene radicals or is a block copolymer or randomly composed polymer containing the radicals mentioned, $R^g$ is an optionally branched, optionally cyclic hydrocarbon radical having 1 to 30 C atoms which optionally contains double bonds, Z is a radical from the group consisting of a nitrogen atom, an oxygen atom, —OC—(O)—, —NH—C(O)— and —($CH_3$)N—C(O)—, n=1 if Z is not a nitrogen atom and o=1;

n=2 if Z is a nitrogen atom and o=1;

n=1 if Z is a nitrogen atom and o=2;

k and l independently of one another are 1 to 4, wherein k is preferably 2 or 3, and l is preferably 1, m has a value from 0 to 30, preferably 1 to 10, in particular 3 to 7 and $A^-$ is an anion and commercially available liquid esterquat rinse cycle softeners.

In this context the heteroatom substituents of the radical $R^a$ can comprise an amino group and/or a sulfonic acid group. The radical $R^a$ of the betaine ester derivatives preferably comprises a long-chain alkyl radical having 7 to 21 C atoms, in particular a long-chain alkyl radical having 9 to 17 C atoms.

Preferably, in the context of the present invention, Y according to the formula (II) is a substituted nitrogen atom or phosphorus atom and the radicals $R^b$ and $R^c$ are simultaneously —$CH_3$.

In this context, in particular the radicals $R^d$ and $R^e$ can simultaneously be H.

In a preferred embodiment, X is —C(O)—NH— or C(O)—N($CH_3$)—.

Betaine ester derivatives in which n=1 and o=1 and Z is an oxygen atom and/or k=2 or 3 and l=1 are particularly preferred.

$R^f$ is preferably an ethylene radical or a propylene radical.

Rinse cycle fabric softener formulations which comprise betaine ester derivatives which are characterized in that m=1 to 10 and $R^g$ is an alkyl radical having 1 to 30 C atoms are furthermore preferred.

A particularly good action is achieved with betaine ester derivatives according to the invention characterized in that Y according to formula (II) is a substituted nitrogen or phosphorus atom, $R^a$ is an alkyl radical having 7 to 21 C atoms, preferably a long-chain alkyl radical having 9 to 17 C atoms, X is —C(O)—NH—, $R^b$ and $R^c$ are —$CH_3$, $R^d$ and $R^e$ are simultaneously H, $R^f$ is an ethylene radical or propylene radical, preferably an ethylene radical, n=1, o=1 and Z is an oxygen atom and k=3, l=1, m=2 and $R^g$ is an alkyl radical having 6 to 22, in particular 8 to 18 C atoms.

Y in this context according to formula (II) should preferably be a substituted nitrogen atom.

Preferably, $R^g$ is the radical of a fatty alcohol which is based on naturally occurring fatty acids and can be prepared by known processes.

Fatty acids which are co-used for the preparation of fatty alcohols are—individually or in mixtures—fatty acids such as caproic acid, caprylic acid, capric acid, 2-ethylhexanoic acid, lauric acid, myristic acid, palmitic acid, palmitoleic acid, isostearic acid, stearic acid, hydroxystearic acid (ricinoleic acid), dihydroxystearic acid, oleic acid, linoleic acid, petrolesic acid, elaidic acid, arachidic acid, behenic acid and erucic acid, gadoleic acid and the technical-grade mixtures obtained on cleavage of naturally occurring fats and oils under pressure, such as oleic acid, linoleic acid, linolenic acid and, in particular, coconut fatty acid, rape seed oil fatty acid, soy bean oil fatty acid, sunflower oil fatty acid and tall oil fatty acid. All fatty acids having a similar chain distribution are suitable in principle.

The content of unsaturated fractions in these fatty acids and fatty acid esters is—if necessary—adjusted to a desired iodine number by the known catalytic hydrogenation processes or is achieved by blending of completely hydrogenated components with non-hydrogenated components.

The iodine number, as a standard index for the average degree of saturation of a fatty acid, is the amount of iodine which is taken up by 100 g of the compound for saturation of the double bonds.

Preferably, partly hydrogenated $C_{8/18}$-coconut or palm fatty acids, rape seed oil fatty acids, sunflower oil fatty acids, soy bean oil fatty acids and tall oil fatty acids having iodine numbers in the range from approx. 80 to 150° C., and in particular technical-grade $C_{8/18}$-coconut fatty acids are employed, whereby a selection of cis/trans isomers, such as $C_{16/18}$-fatty acid cuts rich in elaidic acid may, where appropriate, be of advantage. They are commercially available products and can be obtained from various companies under their particular trade names.

The rinse cycle fabric softener formulations mentioned are particularly suitable for achieving the effect according to the invention if they are furthermore characterized in that the betaine ester derivative is stable to hydrolysis at pH values below 3.5 (at temperatures up to 70° C.) and in the aqueous alkaline range of pH=8 to 14, in particular 9 to 11, is hydrolysed spontaneously with the formation of cationic, anionic, zwitter-ionic and/or nonionic surfactants with the formation of at least one surfactant which is readily fat-soluble and has an HLB value of <10, and at least one surfactant which is readily water-soluble and has an HLB value of >10.

In this context, the rinse cycle fabric softener formulations have a content of at least 1 wt. %, in particular 1 to 10, very particularly 2 to 5 wt. % of at least one of the betaine ester derivatives mentioned, together with 5 to 20 wt. %, in particular 13 to 20 wt. % of one or more esterquat rinse cycle softeners, and the remainder to make up to 100 wt. % of conventional auxiliary substances and additives and optionally water.

The auxiliary substances and additives are preferably chosen from nonionic and ionic dispersing agents, ($C_1$ to $C_5$)-alkanols, ethylene glycol, propylene glycol, polyglycol and derivatives thereof, ethoxylated or propoxylated phenol, benzyl alcohol, isopropanol, isobutanol having an average degree of alkoxylation of >2.5 to 3.5 and dyestuffs and perfume oils, and particular in a content together of up to 5 wt. %, especially 1 to 3 wt. %.

The rinse cycle fabric softener formulations according to the invention comprise betaine ester derivatives having an outstanding substantivity and can thus, once adsorbed on to the fibre, be regarded as a carrier of an ionic and nonionic surfactant which releases this in a controlled manner, that is to say during the next washing operation. In this manner, for the first time nonionic surfactants can be fixed to textile fibres for the following washing operation by temporary incorporation into a cationic compound.

In addition, the rinse cycle fabric softeners according to the invention can comprise one or more further quaternary ammonium compounds.

Quaternary ammonium compounds in this context can be described, for example, by the general formula (III):

(III)

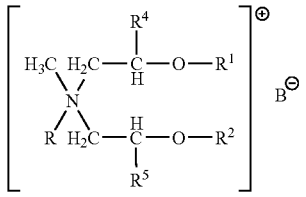

where

R=—$CH_3$, —$CH_2CH_3$, —$CH_2$—CH($R^4$)—$OR^1$ or —$CH_2$—CH($R^5$)—$OR^2$, wherein $R^4$, $R^5$ are identical or different and are H or —$CH_3$, $R^1$, $R^2$=H or —C(O)—$R^3$, wherein $R^3$ is an optionally substituted hydrocarbon radical having 13 to 19 C atoms which contains at least one double bond, with the proviso that if R is not $CH_3$, $R^1$, $R^2$ on average=H at least 1 to 1.4 times and if R=$CH_3$, $R^1$, $R^2$ on average=H a maximum of 0.4 times, and $B^-$ is an anion of a quaternizing agent, in particular of dimethyl sulfate, diethyl sulfate or methyl chloride.

In this context, quaternary ammonium compounds which are particularly preferred are those which are characterized in that $R^4$=H and $R^5$=—$CH_3$ or $R^4$, $R^5$=—$CH_3$ or R=—$CH_2$—CH($CH_3$)—$OR^{1\ or\ 2}$ and $R^4$, $R^5$=—$CH_3$ or R=—$CH_2$—$CH_2$—$OR^{1\ or\ 2}$ and $R^4$, $R^5$=H.

The method according to the invention for improving the washing performance of detergents provides the following steps:

(A) elimination of the residual alkalinity resulting from the washing operation;

(B) after-treatment of the clean laundry with a rinse cycle fabric softener formulation as defined above at pH values below 3.5 and (C) washing of the laundry soiled by use or in another manner with a detergent in the aqueous alkaline range.

Alternatively, to improve the washing performance an after-treatment of the clean laundry according to step (B) an after-treatment can also be carried out exclusively with betaine ester formulations. The subsequent washing operation is carried out analogously to (C).

The required pH values are established by a neutralization step with sufficient amounts of inorganic, but preferably conventional organic mono- or polybasic acids. When using rinse cycle fabric softener formulations, it is also advantageous to employ corresponding buffer substances instead of acids.

A washing operation conventionally comprises introducing the dry or damp soiled laundry into the washing machine and cleaning it with the aid of the added detergents and the washing machinery. In this context, the conventional detergents of the prior art wet the dirt on the textile fibres exclusively from the outside. There are initially no surfactant molecules between the textile fibres and the dirt particles.

To increase the cleaning performance of a washing operation, it is desirable to have available surfactant molecules which are capable of also effecting wetting of the dirt particles from the reverse side, that is to say from the fibre side. By this means, the wetting or phase inversion of the dirt particles is then accelerated or improved. To realize this possibility, it is necessary to fix surfactant molecules on the clean textile fibre after the actual washing operation. When the now clean textile fibre is worn, dirt particles are not deposited directly on the fibre, but on top of the rinse cycle fabric softener formulations according to the invention which are fixed on the fibre. During the next washing operation, the rinse cycle fabric softener formulations according to the invention are hydrolysed and release both an ionic and a nonionic surfactant, which can effect detachment of the dirt particles from underneath.

On hydrolysis of the betaine esters in the betaine ester derivatives according to the invention, a fat-soluble fatty alcohol ethoxylate and a readily water-soluble betaine surfactant are released. This combination is ideal for an effective removal of dirt. Conventional rinse cycle softener formulations, such as those described, for example, in DE-A-35 05 269, which likewise comprise cationic betaine ester derivatives, do not have these properties because they have a different molecular structure.

EMBODIMENT EXAMPLES

In a use comparison, the influence of the rinse cycle fabric softener formulations according to the invention was investigated in respect of their influence on the soft handle of the laundry and on the washing power of commercially available laundry detergents.

The soft handle was investigated on commercially available cotton terry cloth.

As rinse cycle softeners, in each case 18% strength by wt. aqueous rinse cycle softener formulations were prepared from commercially available esterquats (e.g. Rewoquat® WE 18) and in recipes 2 to 11 according to the invention using additives, the additives according to recipes 2 to 11 in general being present at a level of 2 wt. %, based on the finished rinse cycle softener, in the case of recipes 3 and 6 at a level of 5% and in the case of recipes 4 and 7 at a level of 9 wt. %.

The formulations according to the invention with the additions of the betaine ester derivatives Ia–f should ideally have neutral properties in respect of the soft handle of the treated fabric. A negative effect on the soft handle led to a devaluation of the overall evaluation.

For the evaluation of the soft handle, the use concentration of all the rinse cycle softener formulations was 0.025 wt. %.

After the application, the terry cloth was evaluated in respect of its soft handle by a panel of 10 trained persons. All the formulations containing betaine ester were compared directly with the rinse cycle softener without betaine ester (WE 18). In this evaluation, (5)=very soft and (1)=hard.

All the data in table 1 are means of the test group.

TABLE 1

| Formulation | Soft handle |
|---|---|
| Recipe 1 | 4 |
| Recipe 2 | 3.9 |
| Recipe 3 | 3.2 |
| Recipe 4 | 2.7 |
| Recipe 5 | 3.9 |
| Recipe 6 | 3.3 |
| Recipe 7 | 2.6 |
| Recipe 8 | 3.8 |
| Recipe 9 | 3.7 |
| Recipe 10 | 3.8 |
| Recipe 11 | 3.7 |
| 3% recipe 4 | 1.4 |
| 5% recipe 4 | 1.6 |

Recipes:

Betaine esters of the general formula (I) wherein Y=N—CH, $R^b$=—$CH_3$, $R^d$, $R^e$=H, k=3, l=2, n=1 were employed.

The radicals R=$R^a$—X— and R'=($R^f$=($R^f$—O)$_m$—$R^f$-Z-($R^g$) have been specified in the particular recipe examples.

The following recipes were employed as rinse cycle fabric softener agents:

Recipe 1 (Comparison):
18 wt.-% Rewoquat® WE 18

Recipe 2 (According to the Invention):
16 wt.-% Rewoquat® WE 18
2 wt.-% betaine ester Ia R=cocoamido-, R'=$C_{18}H_{37}O(C_2H_4O)_4$—

Recipe 3 (According to the Invention):
13 wt.-% Rewoquat® WE 18
5 wt.-% betaine ester Ia R=cocoamido-, R'=$C_{18}H_{37}O(C_2H_4O)_4$—

Recipe 4 (According to the Invention):
9 wt.-% Rewoquat® WE 18
9 wt.-% betaine ester Ia R=cocoamido-, R'=$C_{18}H_{37}O(C_2H_4O)_4$—

Recipe 5 (According to the Invention):
16 wt.-% Rewoquat® WE 18
2 wt.-% betaine ester Ib R=$C_{17}H_{35}C(O)NH$—, R'=$C_{12}H_{25}O(C_2H_4O)_4$—

Recipe 6 (According to the Invention):
13 wt.-% Rewoquat® WE 18
5 wt.-% betaine ester Ib R=$C_{17}H_{35}C(O)NH$—, R'=$C_{12}H_{25}O(C_2H_4O)_4$—

Recipe 7 (According to the Invention):
9 wt.-% Rewoquat® WE 18
9 wt.-% betaine ester Ib R=$C_{17}H_{35}C(O)NH$—, R'=$C_{12}H_{25}O(C_2H_4O)_4$—

Recipe 8 (According to the Invention):
16 wt.-% Rewoquat® WE 18
2 wt.-% betaine ester Ic R=$C_{11}H_{23}C(O)NH$—, R'=$C_{12}H_{25}O(C_2H_4O)_4$—

Recipe 9 (According to the Invention):
16 wt.-% Rewoquat® WE 18
2 wt.-% betaine ester Id R=$CH_3C(O)NH$—, R'=$C_{12}H_{25}O(C_2H_4O)_4$—

Recipe 10 (According to the Invention):
16 wt.-% Rewoquat® WE 18
2 wt.-% betaine ester Ie R=$C_{11}H_{23}C(O)NH$—, R'=$C_{12}H_{25}O(C_2H_4O)_4$—

Recipe 11 (According to the Invention):
16 wt.-% Rewoquat® WE 18
2 wt.-% betaine ester If R=$CH_3C(O)NH$—, R'=$C_{12}H_{25}O(C_2H_4O)_4$—

The results show that a low content of betaine ester practically does not influence the soft handle compared with the pure esterquat formulation of recipe 1.

On the basis of this evaluation, the rinse cycle fabric softener formulations with a maximum of 2 wt. % of betaine ester were employed for the washing power investigations.

In order to simulate possible higher use concentrations of the betaine esters, the rinse cycle softeners were dosed both with the conventional concentration of 0.025 wt. % of active content and with an excessive concentration of 0.075 wt. %.

Artificially soiled "stain monitors" from EMPA were used for evaluation of the washing power. These "stain monitors" comprise 16 different types of dirt on one piece of textile, so that a quite comprehensive evaluation of the washing performance or stain removal is possible.

Both the commercially available "monitors" (test textiles soiled in a standardized manner) and specially pretreated ones were used. The specially pretreated ones were first subjected to the conventional prewashing process of EMPA, and in addition to this the residual alkalinity resulting from the washing operation was eliminated in a neutralization step. This step can be programmed, but without problems, into an industrial washing unit, and with the usual washing programmes in a commercially available domestic washing machine it is to be manually selected intermediately. It is necessary in order to avoid premature hydrolysis of the betaine ester derivatives according to the invention. After the neutralization, the "monitors" were treated with a rinse cycle fabric softener.

For the investigation, the washing experiments were carried out in Miele washing machines model W 715 and W 918.

In each case 20 "stain monitors" and 2 kg of ballast fabric were washed per washing load. The washing temperature was 40° C. with the short coloured laundry washing programme. "Persil® Colour Gel", a liquid or gel detergent from Henkel, and "Ariel® Essentiel", a powder detergent from Procter & Gamble, were employed as the test detergents. To quantify the removal of dirt, the stains on the Monitors were measured with the aid of a Dr. Lange "Luci® 100" calorimeter before and after the washing. The percentage removal of dirt can be calculated with the aid of the reference value of the non-stained test fabric and the two measurement values.

Washing Results:

The means for the removal of dirt are shown in the following tables.

To facilitate the evaluation and to enable the improvement in the washing action in various fields of use to emerge to a better degree, a standardization was performed. For the standardization, the values of recipe 1 (pure rinse cycle softener) were set at 100 and the deviation of the recipes 2, 5, 8, 9, 10 and 11 containing betaine esters were stated in each case for the two concentrations of 0.025 wt. % and 0.075 wt. %. In conclusion, the mean was obtained over the values within a column.

The evaluation shows that a good intensification of the washing power is to be found for all the recipes according to the invention, either in one of the two concentrations or in combination with powder and/or liquid detergents. It also shows that the betaine esters employed according to the invention can be optimized for the particular specific purpose.

TABLE 2

| Powder detergent (batch 1) | | | | |
|---|---|---|---|---|
| Soiling | No rinse cycle softener* | Recipe 1++ 0.025 wt. % | Recipe 2++ 0.025 wt. % | Recipe 2++ 0.075 wt. % |
| Make-up | 59.3 | 58.0 | 62.5 | 57.2 |
| Curry | 81.7 | 84.3 | 89.8 | 92.0 |
| Red wine | 63.9 | 61.4 | 66.9 | 61.8 |
| Spaghetti sauce | 87.9 | 84.8 | 91.9 | 96.5 |
| Dessert | 74.7 | 75.6 | 75.8 | 80.0 |
| Peat | 61.0 | 58.4 | 65.4 | 61.2 |
| Tea | 56.8 | 54.8 | 62.2 | 66.9 |
| beta-Carotene | 72.1 | 77.6 | 75.0 | 90.0 |
| Grass | 89.0 | 60.1 | 91.7 | 95.1 |
| Anim. fat | 27.9 | 43.5 | 49.1 | 44.2 |
| Baby puree | 76.3 | 73.4 | 81.3 | 82.7 |
| Alumina | 46.4 | 49.2 | 48.9 | 51.2 |
| Butter | 78.1 | 82.9 | 82.8 | 89.8 |
| Engine oil | 55.1 | 62.2 | 54.0 | 60.4 |
| Mean (standardized) | | 100.0 | 108.3 | 110.9 |

*comparison
++according to the invention

TABLE 3

| Liquid detergent (batch 1) | | | | |
|---|---|---|---|---|
| Soiling | No rinse cycle softener* | Recipe 1++ 0.025 wt. % | Recipe 2++ 0.025 wt. % | Recipe 2++ 0.075 wt. % |
| Make-up | 63.8 | 64.5 | 65.7 | 61.7 |
| Curry | 77.0 | 75.6 | 77.0 | 74.7 |
| Red wine | 53.6 | 55.2 | 53.6 | 52.9 |
| Spaghetti sauce | 84.9 | 86.7 | 87.6 | 78.8 |
| Dessert | 59.6 | 60.3 | 61.6 | 62.5 |
| Peat | 53.4 | 46.7 | 53.8 | 46.6 |
| Tea | 8.8 | 8.5 | 9.8 | 8.5 |
| beta-Carotene | 63.0 | 82.1 | 88.6 | 76.2 |
| Grass | 88.4 | 84.3 | 88.9 | 86.7 |
| Anim. fat | 29.8 | 36.4 | 39.4 | 37.7 |
| Baby puree | 77.7 | 76.0 | 87.7 | 75.0 |
| Alumina | 41.1 | 43.4 | 42.3 | 43.7 |
| Butter | 78.5 | 78.1 | 82.3 | 78.0 |

TABLE 3-continued

| Liquid detergent (batch 1) | | | | |
|---|---|---|---|---|
| Soiling | No rinse cycle softener* | Recipe 1++ 0.025 wt. % | Recipe 2++ 0.025 wt. % | Recipe 2++ 0.075 wt. % |
| Engine oil | 67.6 | 62.5 | 73.6 | 57.4 |
| Mean (standardized) | | 100.00 | 106.6 | 98.2 |

*comparison
++according to the invention

TABLE 4

| Powder detergent (batch 1) | | | | |
|---|---|---|---|---|
| Soiling | No rinse cycle softener* | Recipe 1++ 0.025 wt. % | Recipe 5++ 0.025 wt. % | Recipe 5++ 0.075 wt. % |
| Make-up | 59.3 | 58.0 | 69.6 | 55.5 |
| Curry | 81.7 | 84.3 | 93.5 | 89.8 |
| Red wine | 63.9 | 61.4 | 72.1 | 67.6 |
| Spaghetti sauce | 87.9 | 84.8 | 97.6 | 94.2 |
| Dessert | 74.7 | 75.6 | 81.1 | 83.8 |
| Peat | 61.0 | 58.4 | 66.0 | 61.5 |
| Tea | 56.8 | 54.8 | 69.8 | 64.9 |
| beta-Carotene | 72.1 | 77.6 | 94.2 | 86.9 |
| Grass | 89.0 | 60.1 | 100 | 90.7 |
| Anim. fat | 27.9 | 43.5 | 43.9 | 47.2 |
| Baby puree | 76.3 | 73.4 | 97.5 | 78.1 |
| Alumina | 46.4 | 49.2 | 58.5 | 54.6 |
| Butter | 78.1 | 82.9 | 95.8 | 88.2 |
| Engine oil | 55.1 | 62.2 | 63.8 | 67.9 |
| Mean (standardized) | | 100 | 119.3 | 111.6 |

*comparison
++according to the invention

TABLE 5

| Liquid detergent (batch 1) | | | | |
|---|---|---|---|---|
| Soiling | No rinse cycle softener* | Recipe 1++ 0.025 wt. % | Recipe 5++ 0.025 wt. % | Recipe 5++ 0.075 wt. % |
| Make-up | 63.8 | 64.5 | 65.6 | 59.2 |
| Curry | 77.0 | 75.6 | 72.8 | 80.5 |
| Red wine | 53.6 | 55.2 | 49.3 | 57.5 |
| Spaghetti sauce | 84.9 | 86.7 | 82.7 | 95.2 |
| Dessert | 59.6 | 60.3 | 62.0 | 70.5 |
| Peat | 53.4 | 46.7 | 47.2 | 50.4 |
| Tea | 8.8 | 8.5 | 1.6 | 13.8 |
| beta-Carotene | 63.0 | 82.1 | 75.6 | 98.6 |
| Grass | 88.4 | 84.3 | 84.3 | 93.2 |
| Anim. fat | 29.8 | 36.4 | 41.1 | 39.6 |
| Baby puree | 77.7 | 76.0 | 75.2 | 91.0 |
| Alumina | 41.1 | 43.4 | 43.0 | 55.7 |
| Butter | 78.5 | 78.1 | 79.9 | 87.2 |
| Engine oil | 67.2 | 62.5 | 68.8 | 39.0 |
| Mean (standardized) | | 100 | 94.3 | 111.5 |

*comparison
++according to the invention

TABLE 6

Powder detergent (batch 2)

| Soiling | No rinse cycle softener* | Recipe 1++ 0.025 wt. % | Recipe 8++ 0.025 wt. % | Recipe 8++ 0.075 wt. % |
|---|---|---|---|---|
| Make-up | 65.9 | 87.0 | 88.3 | 85.7 |
| Curry | 86.3 | 89.0 | 91.1 | 87.4 |
| Red wine | 65.7 | 62.5 | 69.9 | 61.7 |
| Spaghetti sauce | 92.9 | 86.8 | 94.1 | 81.0 |
| Dessert | 72.5 | 81.1 | 82.2 | 85.8 |
| Peat | 65.3 | 68.4 | 67.4 | 70.5 |
| Tea | 68.3 | 75.9 | 70.5 | 71.9 |
| beta-Carotene | 73.7 | 72.8 | 78.2 | 76.2 |
| Grass | 95.5 | 96.7 | 97.2 | 94.6 |
| Anim. fat | 57.5 | 54.4 | 49.1 | 62.2 |
| Baby puree | 77.8 | 79.5 | 78.6 | 76.0 |
| Alumina | 52.0 | 68.7 | 62.8 | 73.8 |
| Butter | 77.3 | 79.3 | 83.8 | 83.1 |
| Engine oil | 54.3 | 57.1 | 56.3 | 61.9 |
| Mean (standardized) | | 100 | 100.7 | 101.8 |

*comparison
++according to the invention

TABLE 7

Liquid detergent (batch 2)

| Soiling | No rinse cycle softener* | Recipe 1++ 0.025 wt. % | Recipe 8++ 0.025 wt. % | Recipe 8++ 0.075 wt. % |
|---|---|---|---|---|
| Make-up | 76.2 | 73.8 | 86.4 | 85.5 |
| Curry | 74.9 | 74.2 | 80.0 | 77.6 |
| Red wine | 48.0 | 51.4 | 54.1 | 49.9 |
| Spaghetti sauce | 86.8 | 78.1 | 88.8 | 78.4 |
| Dessert | 63.8 | 63.1 | 68.0 | 71.5 |
| Peat | 58.2 | 54.6 | 54.2 | 57.7 |
| Tea | 5.5 | 4.6 | 7.7 | 0.1 |
| beta-Carotene | 71.4 | 71.6 | 76.1 | 75.4 |
| Grass | 93.3 | 90.5 | 93.9 | 88.5 |
| Anim. fat | 31.6 | 11.3 | 35.5 | 27.1 |
| Baby puree | 69.3 | 68.6 | 74.0 | 67.2 |
| Alumina | 46.2 | 53.5 | 54.6 | 63.3 |
| Butter | 73.7 | 74.8 | 80.0 | 79.4 |
| Engine oil | 72.9 | 43.8 | 77.9 | 53.2 |
| Mean (standardized) | | 100 | 131.2 | 109.0 |

*comparison
++according to the invention

TABLE 8

Powder detergent (batch 2)

| Soiling | No rinse cycle softener* | Recipe 1++ 0.025 wt. % | Recipe 9++ 0.025 wt. % | Recipe 9++ 0.075 wt. % |
|---|---|---|---|---|
| Make-up | 65.9 | 87.0 | 82.9 | 85.6 |
| Curry | 86.3 | 89.0 | 89.6 | 91.5 |
| Red wine | 65.7 | 62.5 | 59.5 | 61.8 |
| Spaghetti sauce | 92.9 | 86.8 | 94.4 | 92.2 |
| Dessert | 72.5 | 81.1 | 81.5 | 87.5 |
| Peat | 65.3 | 68.4 | 66.6 | 70.2 |
| Tea | 68.3 | 75.9 | 67.1 | 70.7 |
| beta-Carotene | 73.7 | 72.8 | 79.0 | 84.1 |
| Grass | 95.5 | 96.7 | 97.6 | 96.5 |
| Anim. fat | 57.5 | 54.4 | 55.2 | 65.3 |
| Baby puree | 77.8 | 79.5 | 80.8 | 77.3 |

TABLE 8-continued

Powder detergent (batch 2)

| Soiling | No rinse cycle softener* | Recipe 1++ 0.025 wt. % | Recipe 9++ 0.025 wt. % | Recipe 9++ 0.075 wt. % |
|---|---|---|---|---|
| Alumina | 52.0 | 68.7 | 59.2 | 69.9 |
| Butter | 77.3 | 79.3 | 82.4 | 86.2 |
| Engine oil | 54.3 | 57.1 | 56.4 | 63.9 |
| Mean (standardized) | | 100 | 99.1 | 104.6 |

*comparison
++according to the invention

TABLE 9

Liquid detergent

| Soiling | No rinse cycle softener* | Recipe 1++ 0.025 wt. % | Recipe 9++ 0.025 wt. % | Recipe 9++ 0.075 wt. % |
|---|---|---|---|---|
| Make-up | 76.2 | 73.8 | 83.6 | 83.8 |
| Curry | 74.9 | 74.2 | 76.2 | 80.4 |
| Red wine | 48.0 | 51.4 | 52.2 | 53.3 |
| Spaghetti sauce | 86.8 | 78.1 | 74.2 | 87.9 |
| Dessert | 63.8 | 63.1 | 67.9 | 73.2 |
| Peat | 58.2 | 54.6 | 59.3 | 54.3 |
| Tea | 5.5 | 4.6 | 6.9 | 4.7 |
| beta-Carotene | 71.4 | 71.6 | 71.5 | 81.4 |
| Grass | 93.3 | 90.5 | 95.6 | 91.5 |
| Anim. fat | 31.6 | 11.3 | 34.0 | 21.8 |
| Baby puree | 69.3 | 68.6 | 77.3 | 73.8 |
| Alumina | 46.2 | 53.5 | 54.2 | 61.2 |
| Butter | 73.7 | 74.8 | 80.9 | 80.9 |
| Engine oil | 72.9 | 43.8 | 82.6 | 54.5 |
| Mean (standardized) | | 100 | 128.3 | 115.6 |

*comparison
++according to the invention

TABLE 10

Powder detergent (batch 2)

| Soiling | No rinse cycle softener* | Recipe 1++ 0.025 wt. % | Recipe 10++ 0.025 wt. % | Recipe 10++ 0.075 wt. % |
|---|---|---|---|---|
| Make-up | 65.9 | 87.0 | 83.0 | 88.8 |
| Curry | 86.3 | 89.0 | 87.0 | 92.2 |
| Red wine | 65.7 | 62.5 | 56.6 | 57.7 |
| Spaghetti sauce | 92.9 | 86.8 | 84.7 | 92.8 |
| Dessert | 72.5 | 81.1 | 82.1 | 86.2 |
| Peat | 65.3 | 68.4 | 65.0 | 71.2 |
| Tea | 68.3 | 75.9 | 64.4 | 68.7 |
| beta-Carotene | 73.7 | 72.8 | 71.6 | 82.1 |
| Grass | 95.5 | 96.7 | 98.2 | 95.8 |
| Anim. fat | 57.5 | 54.4 | 55.7 | 60.8 |
| Baby puree | 77.8 | 79.5 | 82.2 | 71.5 |
| Alumina | 52.0 | 68.7 | 63.8 | 72.1 |
| Butter | 77.3 | 79.3 | 80.8 | 86.5 |
| Engine oil | 54.3 | 57.1 | 57.5 | 62.5 |
| Mean (standardized) | | 100 | 97.4 | 103.1 |

*comparison
++according to the invention

TABLE 11

Liquid detergent (batch 2)

| Soiling | No rinse cycle softener* | Recipe 1++ 0.025 wt. % | Recipe 10++ 0.025 wt. % | Recipe 10++ 0.075 wt. % |
|---|---|---|---|---|
| Make-up | 76.2 | 73.8 | 80.3 | 83.6 |
| Curry | 74.9 | 74.2 | 72.3 | 80.1 |
| Red wine | 48.0 | 51.4 | 48.5 | 48.5 |
| Spaghetti sauce | 86.8 | 78.1 | 81.5 | 88.8 |
| Dessert | 63.8 | 63.1 | 68.7 | 64.8 |
| Peat | 58.2 | 54.6 | 53.8 | 57.4 |
| Tea | 5.5 | 4.6 | 1.3 | 6.1 |
| beta-Carotene | 71.4 | 71.6 | 75.5 | 81.6 |
| Grass | 93.3 | 90.5 | 96.9 | 91.3 |
| Anim. fat | 31.6 | 11.3 | 39.6 | 22.3 |
| Baby puree | 69.3 | 68.6 | 71.7 | 66.7 |
| Alumina | 46.2 | 53.5 | 54.7 | 64.2 |
| Butter | 73.7 | 74.8 | 82.7 | 81.8 |
| Engine oil | 72.9 | 43.8 | 78.7 | 34.6 |
| Mean (standardized) | | 100 | 121.5 | 113.4 |

*comparison
++according to the invention

TABLE 12

Powder detergent (batch 2)

| Soiling | No rinse cycle softener* | Recipe 1++ 0.025 wt. % | Recipe 11++ 0.025 wt. % | Recipe 11++ 0.075 wt. % |
|---|---|---|---|---|
| Make-up | 65.9 | 87.0 | 72.4 | 80.8 |
| Curry | 86.3 | 89.0 | 83.7 | 85.7 |
| Red wine | 65.7 | 62.5 | 68.0 | 62.9 |
| Spaghetti sauce | 92.9 | 86.8 | 85.8 | 82.0 |
| Dessert | 72.5 | 81.1 | 79.7 | 78.9 |
| Peat | 65.3 | 68.4 | 63.0 | 64.1 |
| Tea | 68.3 | 75.9 | 76.2 | 72.7 |
| beta-Carotene | 73.7 | 72.8 | 73.0 | 74.8 |
| Grass | 95.5 | 96.7 | 95.2 | 93.7 |
| Anim. fat | 57.5 | 54.4 | 64.3 | 66.5 |
| Baby puree | 77.8 | 79.5 | 80.4 | 71.1 |
| Alumina | 52.0 | 68.7 | 56.8 | 65.7 |
| Butter | 77.3 | 79.3 | 82.2 | 87.0 |
| Engine oil | 54.3 | 57.1 | 58.1 | 63.1 |
| Mean (standardized) | | 100 | 98.7 | 111.6 |

*comparison
++according to the invention

TABLE 13

Liquid detergent (batch 2)

| Soiling | No rinse cycle softener* | Recipe 1++ 0.025 wt. % | Recipe 11++ 0.025 wt. % | Recipe 11++ 0.075 wt. % |
|---|---|---|---|---|
| Make-up | 76.2 | 73.8 | 83.9 | 85.8 |
| Curry | 74.9 | 74.2 | 75.0 | 76.8 |
| Red wine | 48.0 | 51.4 | 46.5 | 52.4 |
| Spaghetti sauce | 86.8 | 78.1 | 80.4 | 85.8 |
| Dessert | 63.8 | 63.1 | 66.9 | 74.6 |
| Peat | 58.2 | 54.6 | 53.2 | 51.1 |
| Tea | 5.5 | 4.6 | 2.8 | 4.6 |
| beta-Carotene | 71.4 | 71.6 | 72.6 | 75.0 |
| Grass | 93.3 | 90.5 | 93.2 | 90.9 |
| Anim. fat | 31.6 | 11.3 | 30.6 | 37.9 |
| Baby puree | 69.3 | 68.6 | 71.4 | 64.3 |

TABLE 13-continued

Liquid detergent (batch 2)

| Soiling | No rinse cycle softener* | Recipe 1++ 0.025 wt. % | Recipe 11++ 0.025 wt. % | Recipe 11++ 0.075 wt. % |
|---|---|---|---|---|
| Alumina | 46.2 | 53.5 | 54.6 | 59.8 |
| Butter | 73.7 | 74.8 | 78.9 | 84.3 |
| Engine oil | 72.9 | 43.8 | 73.6 | 76.1 |
| Mean (standardized) | | 100 | 116.2 | 126.9 |

*comparison
++according to the invention

What is claimed is:

1. Rinse cycle fabric softener formulations comprising betaine ester derivatives of the following general formula (I):

(I)

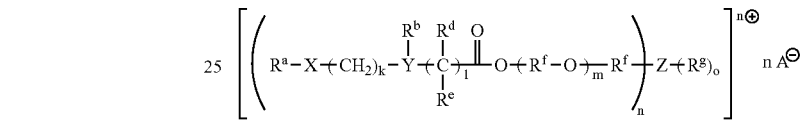

wherein

Y according to the formula (II)

(II)

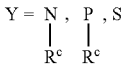

represents a substituted phosphorus or nitrogen atom or a sulfur atom, $R^a$ is an optionally branched, optionally unsaturated radical having 1 to 30 C atoms which optionally contains a hydroxyl group or other heteroatom substituents, X is a radical from the group consisting of —O—C(O)—, —(O)C—O—, —NH—C(O)—, —(O)C—NH, —$(CH_3)$N—C(O)—, —(O)C—N$(CH_3)$—, —S$(O_2)$—O—, —O—S$(O_2)$—, —S$(O_2)$—NH—, —NH—S$(O_2)$—, —S$(O_2)$—N$(CH_3)$— and —N$(CH_3)$—S$(O_2)$—, $R^b$, $R^c$ are independent of one another and are optionally branched alkyl radicals having 1 to 4 C atoms, where these can optionally contain heteroatom substituents, the radicals $R^d$, $R^e$ independently of one another are chosen from hydrogen (H), optionally branched alkyl radicals having 1 to 4 C atoms, optionally substituted aryl or benzyl radicals and $CH_2COOH$, $CH_2COOR$, $CH_2CH_2COOH$ and $CH_2CH_2COOR$, $R^f$ is a branched and/or substituted and/or cyclic hydrocarbon radical having 1 to 10 carbon atoms which optionally contains multiple bonds or a styrene radical or is composed exclusively of ethylene, propylene, butylene or styrene radicals or is a block copolymer or randomly composed polymer containing the radicals mentioned, $R^g$ is an optionally branched, optionally cyclic hydrocarbon radical having 1 to 30 C atoms which optionally contains double bonds, Z is a radical from the group consisting of a nitrogen atom, an oxygen atom, —O—C(O)—, —NH—C(O)— and —$(CH_3)$N—C(O)—, n=1 if Z is not a nitrogen atom and o=1;

n=2 if Z is a nitrogen atom and o=1;

n=1 if Z is a nitrogen atom and o=2;

k and l independently of one another are 1 to 4, m has a value from 0 to 30, and $A^-$ is an anion and commercially available liquid esterquat rinse cycle softeners.

2. Rinse cycle fabric softener formulations according to claim 1, wherein the heteroatom substituents of the radical $R^a$ comprise an amino group and/or a sulfonic acid group.

3. Rinse cycle fabric softener formulations according to claim 1, characterized in that the radical $R^a$ of the betaine ester derivatives comprises a long-chain alkyl radical having 7 to 21 C atoms.

4. Rinse cycle fabric softener formulations according claims 1, characterized in that Y according to the formula (II) is a substituted nitrogen atom or phosphorus atom and the radicals $R^b$ and $R^c$ are simultaneously —$CH_3$.

5. Rinse cycle fabric softener formulations according to claim 1, characterized in that the radicals $R^d$ and $R^e$ are simultaneously H.

6. Rinse cycle fabric softener formulations according claim 1, characterized in that X=—C(O)—NH— or C(O)—N$(CH_3)$—.

7. Rinse cycle fabric softener formulations according to claim 1, characterized in that n=1 and o=1 and Z is an oxygen atom.

8. Rinse cycle fabric softener formulations according to claim 1, characterized in that k=2 or 3 and l=1.

9. Rinse cycle fabric softener formulations according to claim 1, characterized in that $R^f$ is an ethylene radical or a propylene radical.

10. Rinse cycle fabric softener formulations according to claim 1, characterized in that m=1 to 10 and $R^g$ is an alkyl radical having 1 to 30 C atoms.

11. Rinse cycle fabric softener formulations according to claim 1, characterized in that Y according to formula (II) is a substituted nitrogen or phosphorus atom, $R^a$ is an alkyl radical having 7 to 21 C atoms, X=—C(O)—NH—, $R^b$ and $R^c$=—$CH_3$, $R^d$ and $R^e$ are simultaneously H, $R^f$ is an ethylene radical or propylene radical, n=1, o=1 and Z is an oxygen atom and k=3, l=1, m=2 and $R^g$ is an alkyl radical having 6 to 22 C atoms.

12. Rinse cycle fabric softener formulations according to claim 11, characterized in that the radical $R^a$ of the betaine ester derivatives comprises a long-chain alkyl radical having 9 to 17 C atoms, $R^f$ is an ethylene radical, and $R^g$ is an alkyl radical having 8 to 18 C atoms.

13. Method for improving the washing performance of detergents, comprising the steps (A) elimination of the residual alkalinity resulting from the washing operation;

(B) after-treatment of the clean laundry with a rinse cycle fabric softener formulation according to one of claim 1 at pH values below 3.5 and (C) washing of the laundry soiled by use or in another manner with a detergent in the aqueous alkaline range.

14. Method for improving the washing performance of detergents, comprising the steps (A) elimination of the residual alkalinity resulting from the washing operation;

(B) after-treatment of the clean laundry with a betaine ester formulation according to one of claim 1 at pH values below 3.5 and (C) washing of the laundry soiled by use or in another manner with a detergent in the aqueous alkaline range.

15. Rinse cycle fabric softener formulations according to claim 1, characterized in that the radical $R^a$ of the betaine ester derivatives comprises a long-chain alkyl radical having 9 to 17 C atoms.

* * * * *